US006668414B1

(12) United States Patent
Benjamin, Jr.

(10) Patent No.: US 6,668,414 B1
(45) Date of Patent: Dec. 30, 2003

(54) SCUFF MARKER REMOVAL TOOL

(76) Inventor: James Benjamin, Jr., 2830 Ithaca Ct., Orlando, FL (US) 32826

( * ) Notice: Subject to any disclaimer, the term of this patent is extended or adjusted under 35 U.S.C. 154(b) by 187 days.

(21) Appl. No.: 09/944,008

(22) Filed: Aug. 31, 2001

(51) Int. Cl.[7] ..... A47L 13/00; A47L 13/10; A47L 25/00

(52) U.S. Cl. ..... 15/104.001; 15/160; 15/210.1

(58) Field of Search ..... 15/210.1, 104.001, 15/211, 212, 228, 1.52, 229.1, 229.2, 229.3, 244.1, 160, 1; 84/422.1, 422.4

(56) References Cited

U.S. PATENT DOCUMENTS 1,810,731 A * 6/1931 Roark ..... 84/422.4
3,380,767 A 4/1968 Barth
D270,762 S * 9/1983 Kaufman ..... D24/119
4,457,038 A 7/1984 Hammond
4,794,663 A 1/1989 Vosbikian
4,926,522 A 5/1990 Wang
5,003,660 A * 4/1991 Oohinata et al. ..... 15/244.1
D328,192 S 7/1992 Windsor
5,435,040 A * 7/1995 McClure ..... 15/244.1
5,531,671 A * 7/1996 Bennett ..... 604/1
5,878,459 A 3/1999 Mc Parland

FOREIGN PATENT DOCUMENTS

GB 2 268 049 A * 5/1994

* cited by examiner

*Primary Examiner*—Robert J. Warden, Sr.
*Assistant Examiner*—Laura C Cole

(57) ABSTRACT

A scuff mark removal tool for removing scuff marks from tile floors with little effort. The scuff mark removal tool includes a flexible ball member having a wall and being adapted to remove scuff marks from a tile floor; and also includes an elongate handle member being removably and securely engaged to the flexible ball member.

4 Claims, 2 Drawing Sheets

SCUFF MARKER REMOVAL TOOL

BACKGROUND OF THE INVENTION

1. Field of the Invention

The present invention relates to scuff mark removers and more particularly pertains to a new scuff mark removal tool for removing scuff marks from tile floors with little effort.

2. Description of the Prior Art

The use of scuff mark removers is known in the prior art. More specifically, scuff mark removers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,926,522; U.S. Pat. No. 4,457,038; U.S. Pat. No. 3,380,767; U.S. Pat. No. 5,878,459; U.S. Pat. No. 4,794,663; and U.S. Pat. No. Des. 328,192.

While these devices fulfill their respective, particular objectives and requirements, the aforementioned patents do not disclose a new scuff mark removal tool. The inventive device includes a flexible ball member having a wall and being adapted to remove scuff marks from a tile floor; and also includes an elongate handle member being removably and securely engaged to the flexible ball member.

In these respects, the scuff mark removal tool according to the present invention substantially departs from the conventional concepts and designs of the prior art, and in so doing provides an apparatus primarily developed for the purpose of removing scuff marks from tile floors with little effort.

SUMMARY OF THE INVENTION

In view of the foregoing disadvantages inherent in the known types of scuff mark removers now present in the prior art, the present invention provides a new scuff mark removal tool construction wherein the same can be utilized for removing scuff marks from tile floors with little effort.

The general purpose of the present invention, which will be described subsequently in greater detail, is to provide a new scuff mark removal tool which has many of the advantages of the scuff mark removers mentioned heretofore and many novel features that result in a new scuff mark removal tool which is not anticipated, rendered obvious, suggested, or even implied by any of the prior art scuff mark removers, either alone or in any combination thereof.

To attain this, the present invention generally comprises a flexible ball member having a wall and being adapted to remove scuff marks from a tile floor; and also includes an elongate handle member being removably and securely engaged to the flexible ball member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new scuff mark removal tool which has many of the advantages of the scuff mark removers mentioned heretofore and many novel features that result in a new scuff mark removal tool which is not anticipated, rendered obvious, suggested, or even implied by any of the prior art scuff mark removers, either alone or in any combination thereof.

It is another object of the present invention to provide a new scuff mark removal tool which may be easily and efficiently manufactured and marketed.

It is a further object of the present invention to provide a new scuff mark removal tool which is of a durable and reliable construction.

An even further object of the present invention is to provide a new scuff mark removal tool which is susceptible of a low cost of manufacture with regard to both materials and labor, and which accordingly is then susceptible of low prices of sale to the consuming public, thereby making such scuff mark removal tool economically available to the buying public.

Still yet another object of the present invention is to provide a new scuff mark removal tool which provides in the apparatuses and methods of the prior art some of the advantages thereof, while simultaneously overcoming some of the disadvantages normally associated therewith.

Still another object of the present invention is to provide a new scuff mark removal tool for removing scuff marks from tile floors with little effort.

Yet another object of the present invention is to provide a new scuff mark removal tool which includes a flexible ball member having a wall and being adapted to remove scuff marks from a tile floor; and also includes an elongate handle member being removably and securely engaged to the flexible ball member.

Still yet another object of the present invention is to provide a new scuff mark removal tool that is easy and convenient to use.

Even still another object of the present invention is to provide a new scuff mark removal tool that effectively buffs tile floors without having to scrub.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
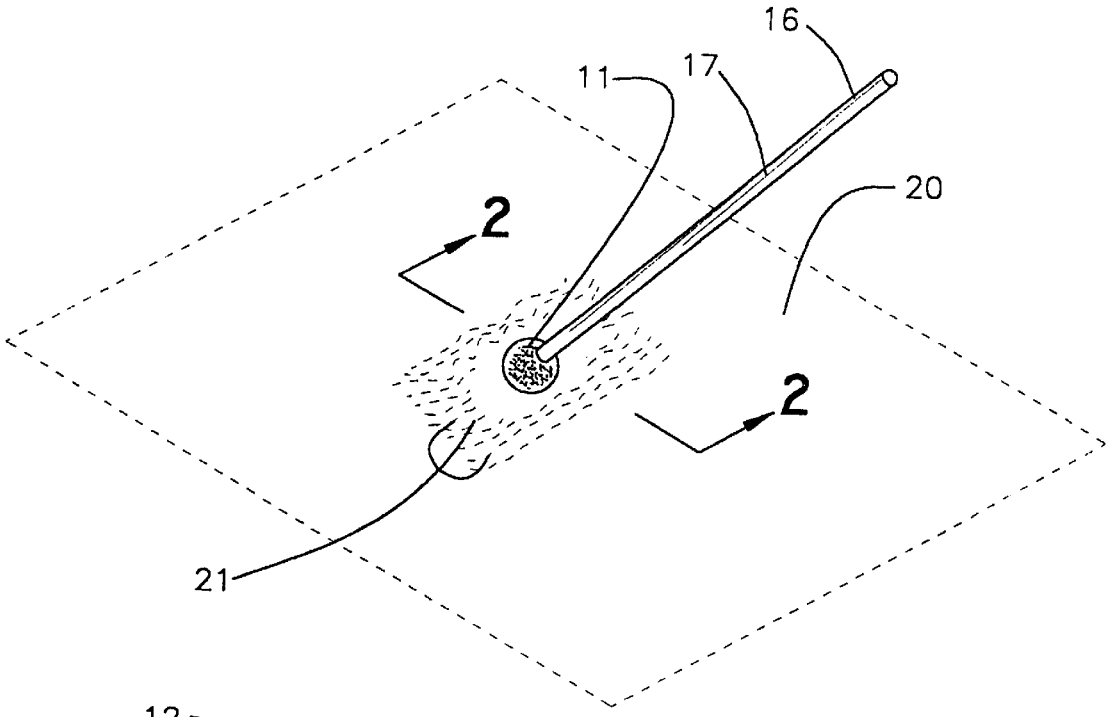
FIG. 1 is a perspective view of a new scuff mark removal tool according to the present invention and shown in use.
Figure 2:
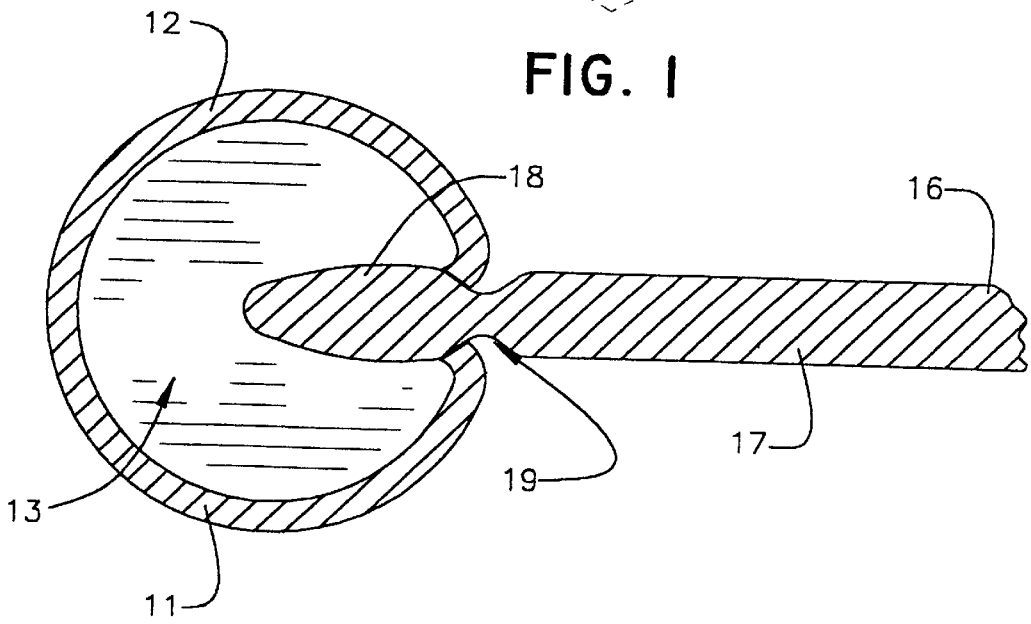
FIG. 2 is a cross-sectional view of the present invention.
Figure 3:
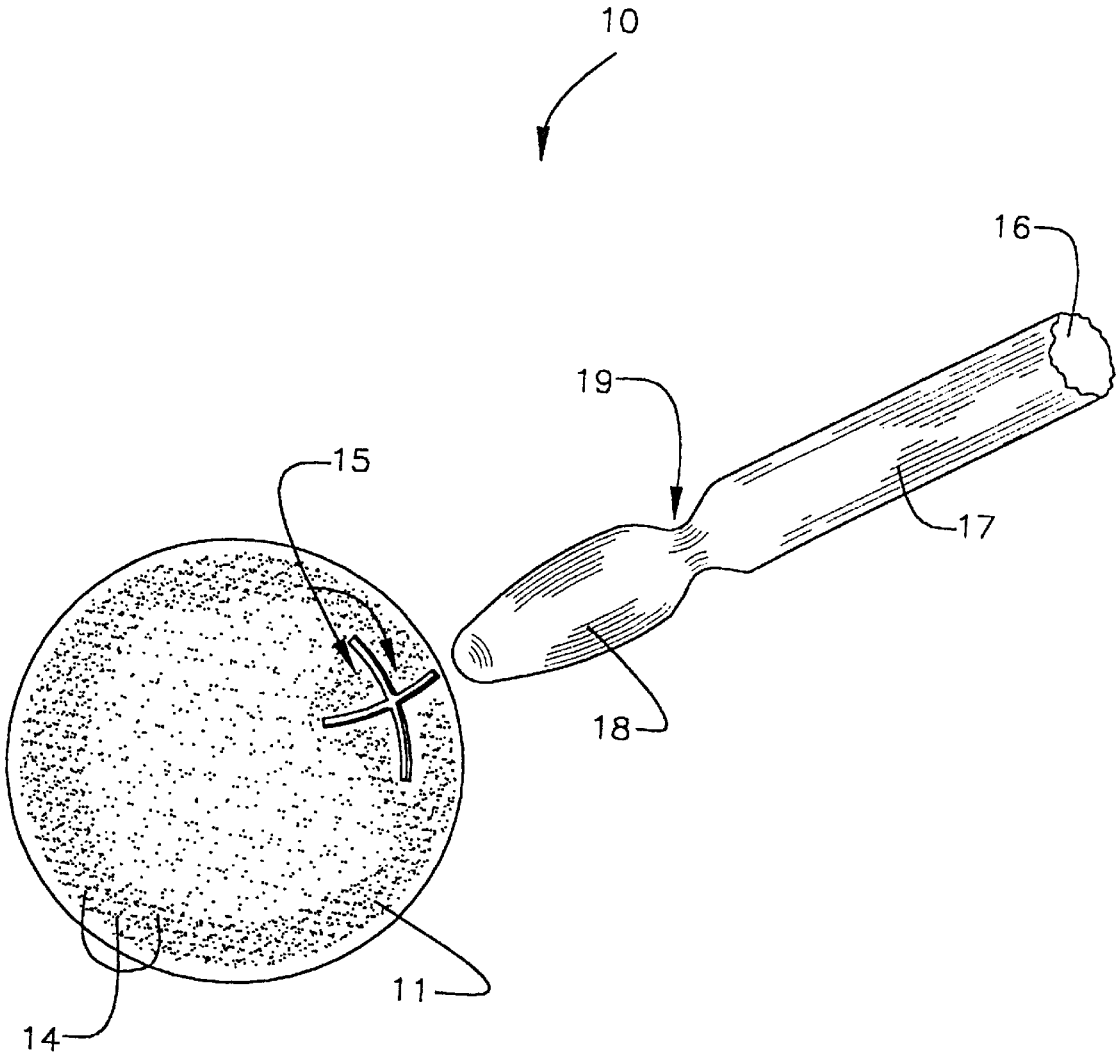
FIG. 3 is a perspective view of the present invention.

With reference now to the drawings, and in particular to FIGS. 1 through 3 thereof, a new scuff mark removal tool embodying the principles and concepts of the present invention and generally designated by the reference numeral 10 will be described.

As best illustrated in FIGS. 1 through 3, the scuff mark removal tool 10 generally comprises a flexible ball member 11 having a wall 12 and being adapted to remove scuff marks 21 from a tile floor 20. The flexible ball member 11 has a hollow interior 13 and has fuzz material 14 conventionally attached to an exterior of the wall 12 of the flexible ball member 11. The flexible ball member 11 includes crosshair slits 15 being disposed through the wall 12 and into the hollow interior 13 thereof.

An elongate handle member 16 is removably and securely engaged to the flexible ball member 11. The elongate handle member 16 includes a main portion 17 and a parabolic end portion 18 being removably extended through the crosshair slits 15 into the flexible ball member 11, and also includes an annular groove 19 being disposed thereabout and separating the main portion 17 from the parabolic end portion 18.

In use, the user grasps the elongate handle member 16 and places and moves the flexible ball member 11 upon a tile floor 20 which removes the scuff marks 21 found upon the tile floor 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scuff mark removal tool comprising:

a flexible ball member having a wall and being adapted to remove scuff marks from a tile floor;

an elongate handle member being removably and securely engaged to said flexible ball member; and wherein said flexible ball member has a hollow interior and has fuzz material attached to an exterior of said wall of said flexible ball member such that said elongate handle member extends into said hollow interior of said flexible ball, an end of said elongate handle member being positioned in said hollow interior of said flexible ball member such that said end of said elongate handle member is positioned in a spaced relationship to an interior surface wherein there is a void between said end of said elongate handle and an opposite interior sidewall of said flexible ball member to allow said flexible ball member to conform to the tile floor to remove scuff marks.

2. A scuff mark removal tool as described in claim 1, wherein said flexible ball member includes crosshair slits being disposed through said wall and into said hollow interior thereof.

3. A scuff mark removal tool as described in claim 2, wherein said elongate handle member includes a main portion and a parabolic end portion being removably extended through said crosshair slits into said flexible ball member, and also includes an annular groove being disposed thereabout and separating said main portion from said parabolic end portion.

4. A scuff mark removal tool comprising:

a flexible ball member having a wall and being adapted to remove scuff marks from a tile floor, said flexible ball member having a hollow interior and having fuzz material attached to an exterior of said wall of said flexible ball member, said flexible ball member including crosshair slits being disposed through said wall and into said hollow interior thereof; and an elongate handle member being removably and securely engaged to said flexible ball member, said elongate handle member including a main portion and a parabolic end portion being removably extended through said crosshair slits into said flexible ball member, and also including an annular groove being disposed thereabout and separating said main portion from said parabolic end portion; and said elongate handle member extending into said hollow interior of said flexible ball, an end of said elongate handle member being positioned in said hollow interior of said flexible ball member such that said end of said elongate handle member is positioned in a spaced relationship to an interior surface wherein there is a void between said end of said elongate handle and an opposite interior sidewall of said flexible ball member to allow said flexible ball member to conform to the tile floor to remove scuff marks.

* * * * *